US006017293A

United States Patent [19]

Pfefferle

[11] Patent Number: 6,017,293

[45] Date of Patent: Jan. 25, 2000

[54] DOORWAY SUPPORTED SWING ASSEMBLY

[76] Inventor: Scott M. Pfefferle, 646 Carroll Sq. (Apt. 2N), Elk Grove Village, Ill. 60007

[21] Appl. No.: 08/882,996

[22] Filed: Jun. 26, 1997

[51] Int. Cl.[7] ..... A63B 1/00

[52] U.S. Cl. ..... 482/40; 482/38; 482/904; 482/104

[58] Field of Search ..... 482/904, 122, 482/92, 39, 40

[56] References Cited

U.S. PATENT DOCUMENTS

| | | | |
|---|---|---|---|
| 1,401,476 | 12/1921 | Strom . | |
| 1,586,899 | 6/1926 | Herring . | |
| 1,676,061 | 7/1928 | Strom . | |
| 2,839,299 | 6/1958 | Weiss . | |
| 3,502,326 | 3/1970 | Schaeffer . | |
| 3,937,463 | 2/1976 | Soisson . | |
| 4,077,403 | 3/1978 | Steele . | |
| 4,229,002 | 10/1980 | Masters | 482/904 |
| 4,522,391 | 6/1985 | Rundall | 482/904 |
| 4,529,191 | 7/1985 | Miller et al. . | |
| 4,619,453 | 10/1986 | Plumridge | 482/904 |
| 4,974,836 | 12/1990 | Hirsch . | |
| 5,050,869 | 9/1991 | Frate | 482/904 |
| 5,072,934 | 12/1991 | Blanes | 482/904 |
| 5,186,696 | 2/1993 | Pfefferle et al. . | |
| 5,462,508 | 10/1995 | Schiavone | 482/904 |
| 5,468,205 | 11/1995 | McFall et al. | 482/904 |
| 5,540,641 | 7/1996 | William et al. | 482/904 |

*Primary Examiner*—Jerome W. Donnelly
*Attorney, Agent, or Firm*—Andrus, Sceales, Starke & Sawall

[57] ABSTRACT

A swing support assembly for use between a pair of upright members of a door frame to support a swing or other piece of playground equipment. The support assembly includes an adjustable support bar which has first and second ends and can be adjusted to vary the distance between the first and second ends. The swing support assembly includes a pair of mounting brackets which are each mounted to an abutment strip on the upright members of the door frame. Each of the mounting brackets include a pair of attachment straps which engage both the bracket body and the abutment strip to securely hold the mounting bracket in place on the upright member of the door frame. The attachment straps contained on the bracket body are adjustable, such that the bracket body can be removably attached to the door frame. One of the mounting brackets includes an adjustable door stop member which is used to prevent the door from closing when the swing support assembly is being used. The door stop member is pivotable between an extended position and a storage position, such that when the door stop member is in the storage position, the door can be closed while the swing support assembly is still installed in the door frame. The mounting brackets of the swing support assembly are positioned adjacent to the abutment strip of the door frame such that the attachment straps and the support bar each provide an independent holding force to retain the mounting brackets in an operating position.

17 Claims, 3 Drawing Sheets

FIG. 1
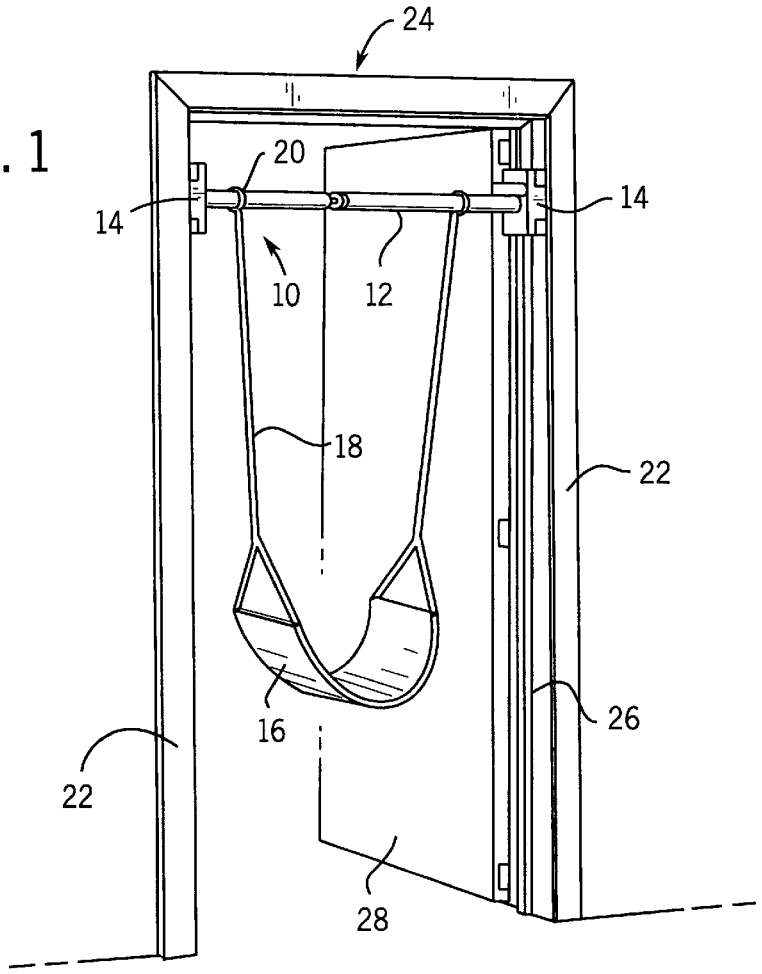
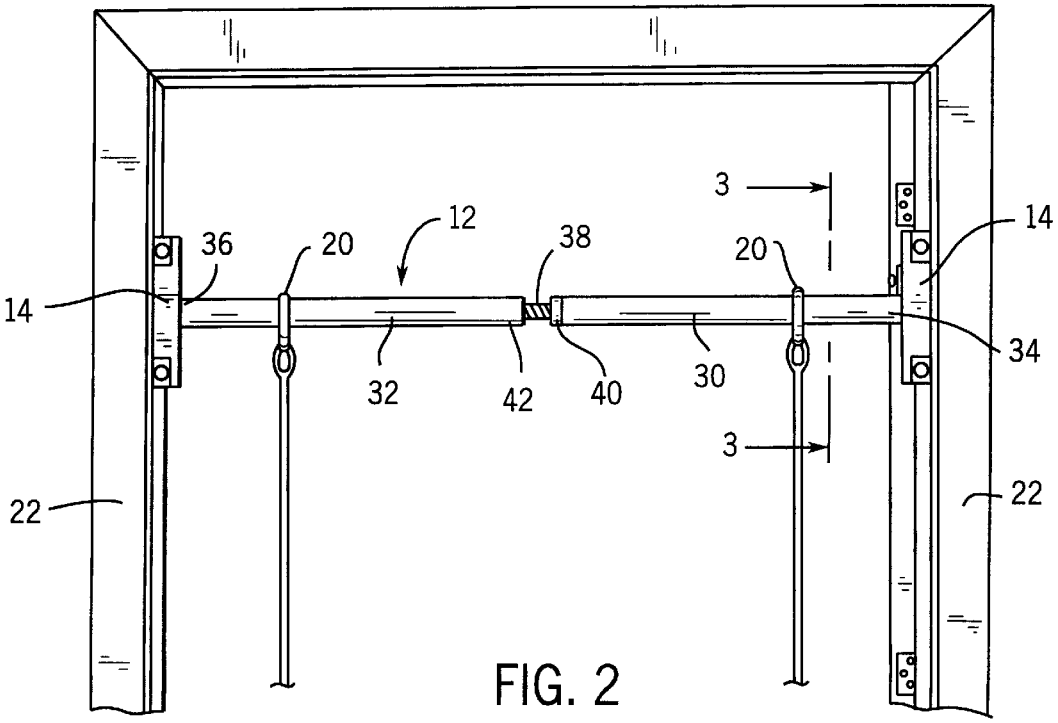
FIG. 2

FIG. 3
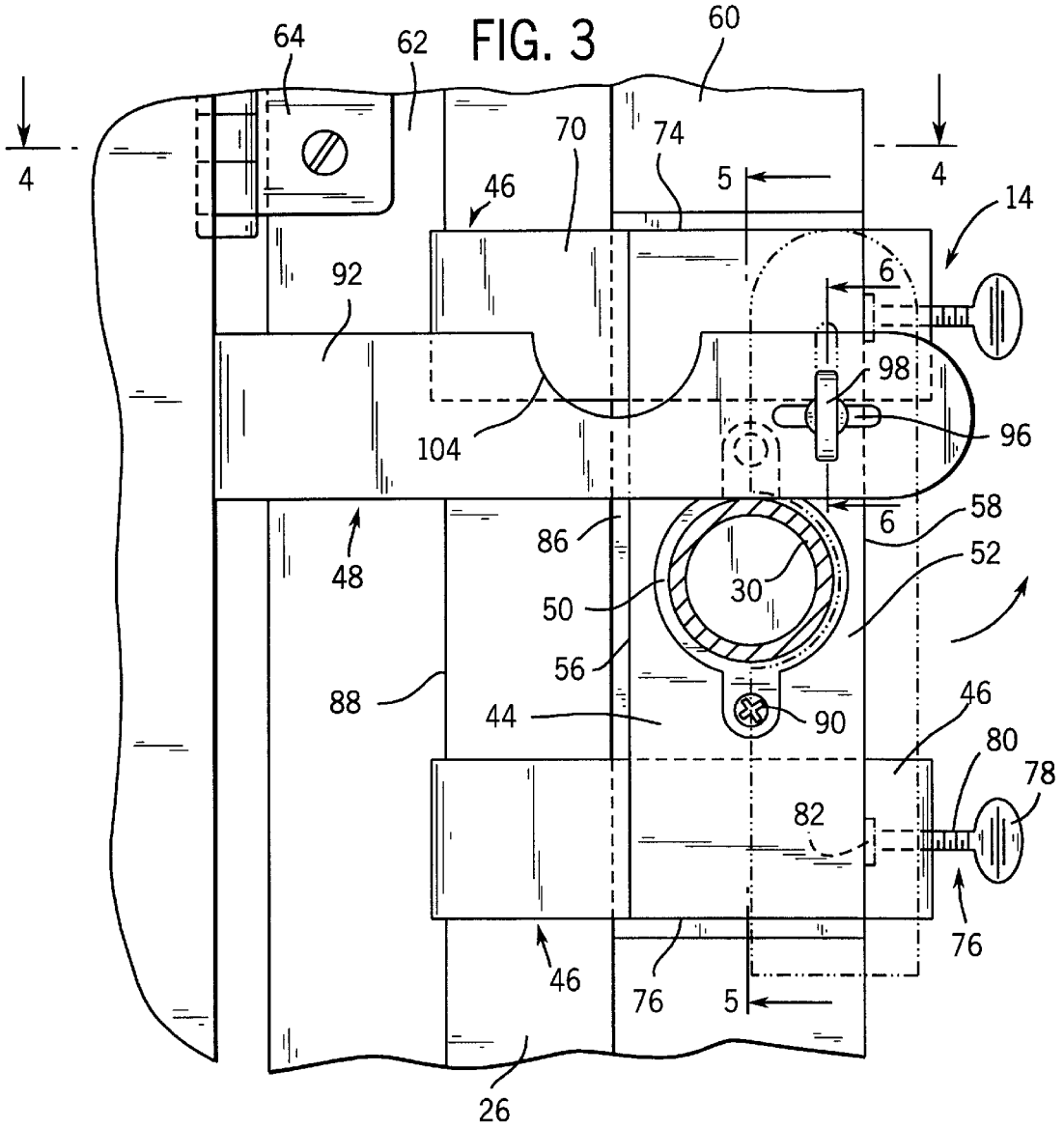
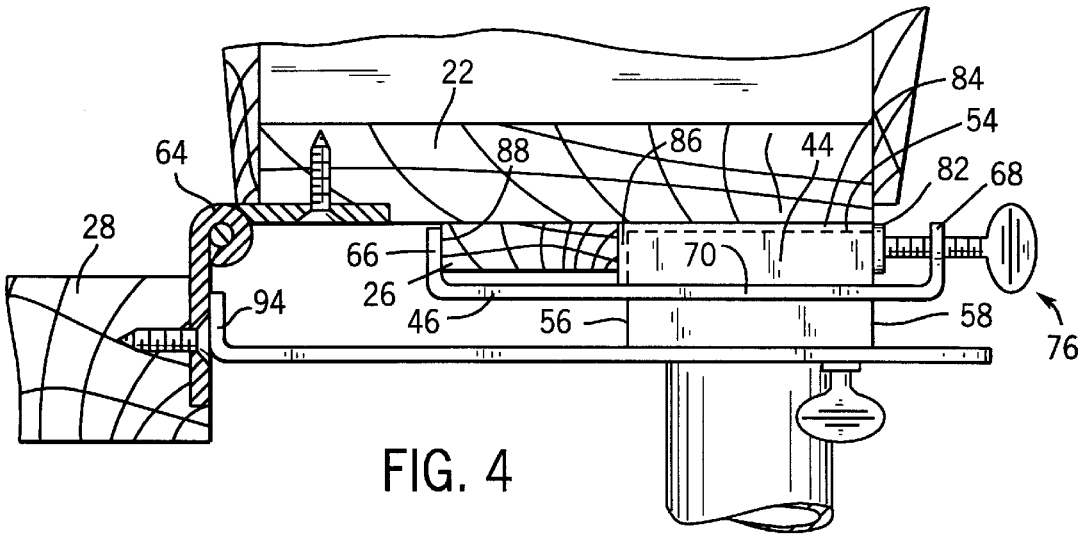
FIG. 4

DOORWAY SUPPORTED SWING ASSEMBLY

BACKGROUND OF THE INVENTION

This invention relates to indoor recreational equipment. More specifically, the invention relates to a swing support assembly that can be removably mounted to a door frame.

In many urban environments, families have a limited amount of recreational space and playground equipment available for use by young children. Families in urban areas are typically forced to leave their homes and go to parks to use such equipment. Often times, parks are located a relatively long distance from the families' homes, making such recreation inconvenient. Additionally, children living in rural or urban areas in northern climates are unable to use the available outdoor playground equipment during the winter months. Therefore, a desire and need exists for playground-type equipment, such as swings, which can be used indoors, such that the recreational equipment can be used both in urban areas and during the winter months in northern climates.

U.S. Pat. No. 5,186,696 to Pfefferle et al. discloses a doorway bar support and operating unit combination in which a variable length cross bar is mounted between the upright members of a door frame. Specifically, the doorway bar support includes a pair of pressure plate members each of which has a receiving channel that receives the upright abutment strip contained on the door frame. The pressure plate member disclosed includes a pair of frictional surfaces that fall on either side of the abutment strip. When the pressure plate members are correctly positioned, the cross bar is extended to exert an outward force such that the doorway bar support is securely held in place. The doorway bar support can then be used to support a variety of attachments within the doorway.

While the doorway bar support mechanism disclosed in the Pfefferle '696 patent functions to support a variety of items within the doorway, the attachment brackets used on each end of the adjustable support bar do not independently engage the door frame apart from the outward force exerted by the cross bar. Since only the outward force from the cross bar holds the support structure in place, if the cross bar become loosened, the entire doorway bar support structure could inadvertently become detached from the door frame in an undesirable manner.

Thus, it can be appreciated that a swing support assembly which engages the door frame separate from and in combination with the outward force supplied by an adjustable support bar would be a desirable improvement. In such a swing support assembly in which the brackets contained on each end of the adjustable support bar independently engage the door frame, if the adjustable support bar become loosened, the brackets would hold the support bar in its original position.

SUMMARY OF THE INVENTION

The present invention is a swing support assembly for use between upright members of a door frame that independently engages the door frame separate from and in combination with an outward force supplied by an adjustable support bar of the swing support assembly.

The swing support assembly of the present invention includes an adjustable length support bar and a pair of mounting brackets. The adjustable length support bar includes a first end and a second end and is adjustable such that the distance between the first and second ends can be varied. The support bar includes a pair of bar members which are joined to each other by the interaction between an externally threaded shaft and an internally threaded bore contained on opposing ends of the bar members. The length of the support bar is adjusted by rotating one bar member relative to the other bar member, such that the threaded connection between the bar members varies the overall length of the support bar.

Each end of the support bar is coupled to one of the mounting brackets. In the operating position, each of the mounting brackets is positioned between one end of the support bar and one of the upright members of the door frame to which the swing support assembly is mounted. When the support bar is adjusted, the support bar exerts an outward force on each of the mounting brackets such that the mounting brackets are pressed securely into contact with the upright member of the door frame. In this manner, the support bar exerts an outward force sufficient to hold the swing support assembly in place with respect to the door frame.

In the present invention, each of the mounting brackets further include a pair of attachment straps that act to independently hold the mounting brackets in place on the upright member of the door frame. In the operating position, the body of the mounting bracket is positioned adjacent to the abutment strip contained on the upright member. When the mounting bracket body is in the operating position, the attachment straps are adjusted such that the attachment straps engage both the abutment strip and the bracket body to hold the mounting bracket in place.

The attachment straps include adjustment means such that the length of the attachment straps can be varied. By tightening the adjustment means, the bracket body can be securely connected to the abutment strip of the upright member of the door frame. In this manner, the mounting brackets are connected to the door frame independent from and in combination with the outward force supplied by the support bar. Thus, should the support bar become loosened, the mounting brackets hold the swing support assembly of the invention in place along the door frame.

In another feature of the invention, the bracket body includes a door stop member which extends horizontally from the bracket body when the mounting bracket is positioned on the door frame. The door stop member is adjustable such that the length of the door stop member extending from the bracket body can be varied. Additionally, the door stop member is rotatable between an extended position and a storage position. When the door stop member is in the storage position, the mounting brackets and the entire swing support assembly can remain connected to the door frame while allowing the door to be closed.

In another feature of the invention, the bracket body includes a friction member contained on at least one of the lateral side surfaces of the bracket body and the back face of the bracket body. The friction member contained on the bracket body increases the friction between the bracket body and the door frame, such that the bracket body resists movement along the door frame when weight is applied to the swing support assembly.

In another feature of the invention, the bracket body includes a metal socket which receives one end of the support bar. The metal socket increases the durability of the bracket body.

Other objects and advantages may appear in the course of the following description.

BRIEF DESCRIPTION OF THE DRAWINGS

The drawings illustrate the best mode presently contemplated of carrying out the invention.

In the drawings:

FIG. 1 is a perspective view of the swing support assembly of the present invention as mounted in a door frame;

FIG. 2 is an elevation view of the swing support assembly of the present invention as mounted in the door frame;

FIG. 3 is an front elevation view taken along line 3—3 of FIG. 2 showing one of the mounting brackets of the swing support assembly;

FIG. 4 is a top plan view taken alone line 4—4 of FIG. 3 showing one of the mounting brackets of the swing support assembly as connected to the door frame;

DESCRIPTION OF THE PREFERRED EMBODIMENT

Figure 5:
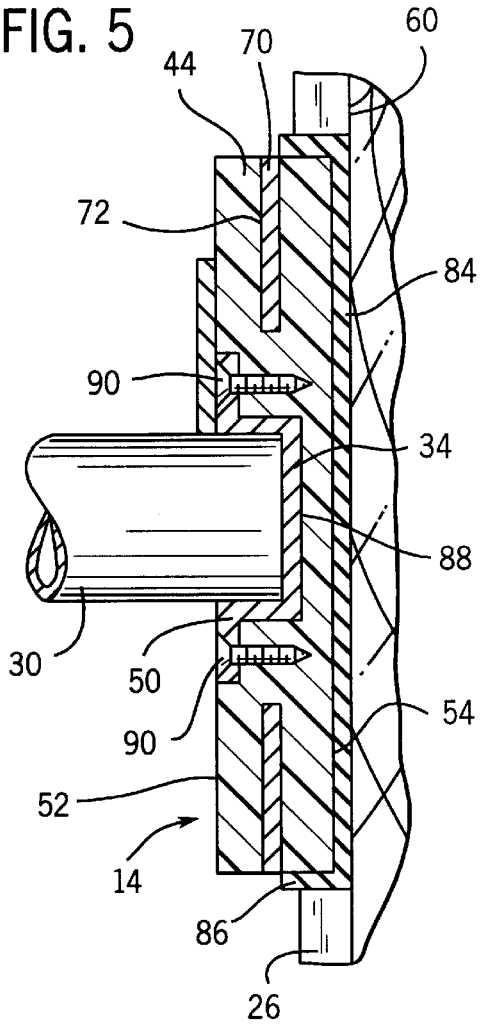
FIG. 5 is a sectional view taken along line 5—5 of FIG. 3.
Figure 6:
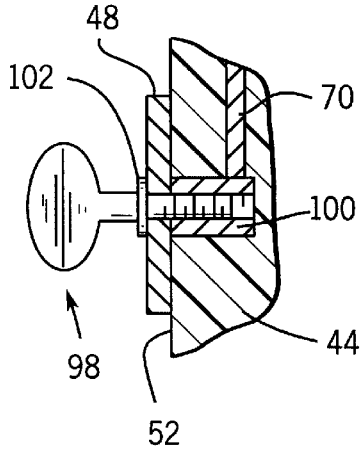
FIG. 6 is a sectional view taken along line 6—6 of FIG. 3.

Referring first to FIG. 1, the swing support assembly of the present invention is thereshown and is generally referred to by reference numeral 10. The swing support assembly 10 includes a support bar 12 and a pair of mounting brackets 14. In the embodiment shown, a swing 16 is attached to the support bar 12 by a pair of ropes 18. The ropes 18 are connected to a pair of rings 20 that encircle the support bar 12, such that the swing 16 is allowed to pivot about the support bar 12 in a conventional manner.

In the preferred embodiment of the invention, the swing support assembly 10 is positioned between the upright members 22 of a conventional door frame 24. Each upright member 22 of the door frame 24 also includes an abutment strip 26 against which the door 28 rests when it is in the closed position.

As can be understood in FIG. 1, in the operating position the swing support assembly 10 is positioned between the pair of upright members 22 at a height such that the swing 16 can be used in a conventional manner. Although a swing 16 is shown in FIG. 1, it should be understood that a variety of other recreational equipment or mechanisms could be attached to the swing support assembly 10, such as, but not limited to, a teeter totter, weight equipment, exercise equipment, or other toys typically attached to an outdoor swing set.

Referring now to FIG. 2, the support bar 12 is a two part assembly including a first bar member 30 and a second bar member 32. In the preferred embodiment of the invention, both the first and second bar members 30, 32 are elongated, cylindrical members each having the same outer diameter. The first bar member 30 includes a first end 34 of the support bar 12, while the second bar member 32 includes a second end 36 of the support bar 12, such that the support bar 12 extends along a longitudinal axis between the first and second ends 34 and 36. Each of the first and second ends 34, 36 of the support bar 12 is coupled to one of the mounting brackets 14 as will be discussed in greater detail below.

The first bar member 30 includes an externally threaded shaft portion 38 that extends longitudinally outward from the inner end 40 of the first bar member 30. The externally threaded shaft portion 38 is received by an internal threaded bore (not shown) extending longitudinally inward from inner end 42 of the second bar member 32. The internal threaded bore contained in the inner end 42 is sized such that it receives the externally threaded shaft portion 38 such that the first and second bar members 30,32 can be joined to form the single support bar 12.

When the first bar member 30 is rotated relative to the second bar member 32, the threaded connection between the externally threaded shaft portion 38 and the internally threaded bore in the second bar member 32 changes the distance between the first end 34 and the second end 36 of the support bar 12. Thus, when the first bar member 30 is rotated in a first direction, the first and second ends 34,36 move further apart, and when the first bar member 30 is rotated in a second, opposite direction, the ends 34, 36 move closer together. The support bar 12 therefore is adjustable lengthwise along its longitudinal axis such that the overall length of the support bar 12 can be adjusted to exert an outward force on the upright members 22 of the door frame 24, as will be discussed further below.

Each of the first and second bar members 30,32 is preferably about 13 inches in length with an outer diameter of about 1½ inches. The bar members 30, 32 are preferably made of high strength aircraft aluminum, but the invention is not limited to such material. The externally threaded shaft portion 38 is preferably about 13 inches in length with a diameter of about ¾ of an inch. The invention is not limited to such dimensions, but such dimensions are appropriate for use with door frames having lateral openings from about 29 inches to about 34 inches and to support weight up to about 400 pounds.

As can be seen in FIG. 2, each of the mounting brackets 14 is positioned between one of the upright members 22 of door frame 24 and one of the first or second ends 34, 36 of the support bar 12 when the swing support assembly 10 is in its operating position. To position the support bar 12 as shown in FIG. 2, the first bar member 30 and the second bar member 32 are rotated with respect to one another such that the distance between the first and second ends 34,36 of the support bar 12 increases. As the length of the support bar 12 increases, the mounting brackets 14 are held securely in place between the support bar 12 and the upright member 22 by the outward force supplied by the support bar 12. When the support bar 12 is sufficiently tightened, the outward force supplied by the support bar 12 increases the friction between the mounting brackets 14 and the upright members 22 such that the support bar 12 is securely held in the position above the floor as shown.

Although not shown, a groove is formed in each of the first and second bar members 30,32 to receive the rings 20. When the rings 20 are seated in the grooves, the grooves prevent the rings 20 from sliding longitudinally along the support bar 12 when the swing 16 is being used, while at the same time allowing the pivoting movement of the rings 20 relative to the fixed support bar 12. In the preferred embodiment of the invention, each of the rings 20 is spaced approximately one to two inches from either the first end 34 or the second end 36 of the support bar 12.

Referring now to FIGS. 3–7, thereshown is the detailed construction the mounting bracket 14 coupled to the first end 34 of the support bar 12. Since both of the mounting brackets 14 are identical except for a door stop member, only the bracket 14 coupled to the first end 34 will be described in the interest of space savings. The mounting bracket 14 generally includes a bracket body 44, a pair of attachment straps 46, a door stop member 48 and a socket 50 which receives one end of the support bar 12. The bracket body 44 extends along a longitudinal axis parallel to the upright member 22 of the door frame 24 and includes a front face 52, a back face 54, and a pair of lateral side surfaces 56 and 58. In the preferred embodiment of the invention shown in FIGS. 3–7, the bracket body 44 has a generally rectangular shape having generally planar front and back face surfaces 52, 54. Additionally, in the preferred embodiment, the bracket body 44 is a solid structure constructed of either wood or plastic, although other materials and shapes are contemplated.

As can be clearly seen in FIG. 3 and 4, when the mounting bracket 14 is in the operating position, the bracket body 44 is positioned directly adjacent to the abutment strip 26 contained on the upright member 22 of the door frame 24. As can be seen in FIG. 3, the abutment strip 26 is positioned between a pair of flat, lateral jamb surfaces 60 and 62 such that when the door 28 is closed, the door 28 contacts the abutment strip 26. The bracket body 44 is positioned such that the back face 54 is aligned with one of the flat, lateral jamb surfaces 60. Hinge 64 of the door 28 is securely connected to the lateral jamb surface 62 on the opposite side of the abutment strip 26 from the lateral jamb surface 60 to which the bracket body 44 is in contact with, the significance of which will be discussed in detail below.

The attachment straps 46 contained on the mounting bracket 14 are each preferably formed from a single piece of stainless steel and are used to independently secure the mounting bracket 14 to the abutment strip 26. The attachment straps 46 each include an engagement flange 66, an adjustment flange 68, and a lateral portion 70. In the preferred embodiment, both the engagement flange 66 and the adjustment flange 68 are perpendicular to the lateral portion 70, as can be seen in FIG. 4. Thus, each of the attachment straps 46 has a generally elongated U-shaped side profile.

Referring now to FIG. 5, the lateral portion 70 of each attachment strap 46 extends perpendicular to the longitudinal axis of the bracket body 44 and is contained in a slot 72 formed in the body 44 of the mounting bracket 14. In the preferred embodiment of the invention, the depth of slot 72 corresponds generally to the width of the lateral portion 70 of the attachment straps 46 such that the attachment straps 46 do not extend past either the upper edge 74 or the lower edge 76 of the body 44, as can be seen in FIG. 3.

An adjustment mechanism, such as but not limited to a threaded key 76, passes through and engages an opening (not shown) contained in the adjustment flange 68 of the attachment strap 46. The threaded key 76 includes a thumb-engageable head 78, a threaded shaft 80 and a pressure disk 82. As can be seen in FIG. 4, the pressure disk 82 contacts the outside lateral side surface 58 of the bracket body 44. When the threaded key 76 is rotated in either direction, the threaded interaction between the shaft 80 and the opening in the adjustment flange 68 changes the distance between the engagement flange 66 of the attachment strap 46 and the lateral side surface 56 of the bracket body 44. For example, when the threaded key 76 is rotated in a first direction, the distance between the engagement flange 66 and the lateral side surface 56 decreases. Likewise, when the threaded key 76 is rotated in a second, opposite direction, the distance between the engagement flange 66 and the lateral side surface 56 increases.

In the preferred embodiment of the invention, the bracket body 44 includes a friction member 84 securely connected to the entire back face surface 54 of the bracket body. The friction member 84 is preferably a resilient material which is relatively soft and has a high coefficient of sliding friction. For example, the friction member 84 can be constructed of a relatively rigid or hard rubber, or other type of friction enhancing material. In addition to the resilient friction member 84 connected to the back face surface 54, the mounting bracket 14 also includes a resilient friction member 86 connected to the interior lateral side surface 56. Additionally, the friction member 86 could also be connected to the upper edge 74 and the lower edge 76. The resilient friction members 84 and 86 can either be connected to the bracket body 44 independently of one another, or could be formed of a single molded piece of resilient material which would be affixed to the back face surface 54, the lateral side surface 56, and both the upper edge 74 and lower edge 76.

As can be seen in FIG. 4, the resilient friction member 86 along the lateral side surface 56 has a height which is greater than the distance the abutment strip 86 extends from the lateral jamb surface 60. Thus, the resilient friction members 84 and 86 not only increase the amount of friction between the mounting bracket 14 and the upright member 22, but they also provide cushioning between the mounting bracket 14 and the upright member 22 and the lateral jamb surface 60 to prevent damage to the door frame 24.

To attach the mounting bracket 14 to the abutment strip 26 of the upright member 22, the bracket body 44 is first placed adjacent to the abutment strip 26 as shown in FIG. 3. In this position, the resilient friction member 84 attached to the back face 54 of the bracket body 44 is in contact with the lateral jamb surface 60, and the friction member 86 attached to the lateral side surface 56 is positioned between the abutment strip 26 and the lateral side surface 56 of the bracket body 44. As previously mentioned, the friction member 86 provides cushioning between the bracket body 44 and the abutment strip 26, as well as enhancing the amount of friction between the bracket body 44 and the abutment strip 26.

Once the bracket body 44 is positioned adjacent to the abutment strip 26, as shown in FIG. 3, each of the attachment straps 46 are adjusted by turning the threaded key 76 until the attachment straps 46 extend far enough from the lateral side surface 56 of the bracket body 44 such that the engagement flange 66 of each attachment strap 46 is able to engage the side edge 88 of the abutment strip 26, as shown in FIG. 4. After the bracket body 44 is correctly positioned and the adjustment straps 46 are adjusted to a sufficient length to engage the abutment strip 26, the threaded key 76 is rotated in the opposite direction to shorten the length of each attachment strap 46. As the threaded key 76 continues to rotate, the pressure disk 82 contacts the lateral side surface 58 of the bracket body 44, thereby causing the bracket body 44 to be pressed into the abutment strip 26. The lateral side surface 58 does not include a friction member like the lateral side surface 56, since the pressure disk 82 requires a hard, flat surface to interact with to exert the required force to hold the mounting bracket 14 in place. By further tightening each of the threaded keys 76, the bracket body 44 can be securely attached to the abutment strip 26 to independently hold the mounting bracket 14 in place separate from the outward force provided by the support bar 12 as previously discussed.

Referring now to FIGS. 3 and 5, a socket 50 is contained in the front face surface 52 of the bracket body 44. In the preferred embodiment of the invention, the socket 50 is a metal element, such as aluminum or stainless steel, which fits into a bored out area 88 in the bracket body 44. The socket 50 is held in place in the bracket body 44 by a pair of screw connectors 90 which are received in a pair of internally threaded bores contained in the bracket body 44. As can be seen in FIG. 5, the first bar member 30 is received in the socket 50 such that the first end 34 of the support bar 12 contacts the bottom of socket 50. In the embodiment shown in the Figures, the support bar 12 is freely removable from the socket 50 contained in the bracket body 44. In a presently contemplated embodiment, the support bar 12 could be rotatably attached to each of the mounting brackets 14 such that the mounting brackets 14 would always be connected to the support bar 12. In the preferred embodiment of the invention, the socket 50 is constructed of lightweight metal, such as aluminum, which is harder and more durable than the bracket body 44. Thus, the outward force applied by the support bar 12 on the mounting brackets 14 is received by the more durable metal socket 50, rather than the bracket body 44.

When the swing support assembly 10 is installed in a doorway as shown in FIG. 1, the adjustable length support bar 12 exerts an outward force to press each of the mounting brackets 14 into contact with the lateral jamb surface 60 of the upright member 22 of door frame 24. Since the friction member 84 is securely connected to the back face 54 of the bracket body 44, the friction member 84 increases the friction between the mounting bracket 14 and the lateral jamb surface 60 to further prevent the mounting bracket 14 from sliding downward when weight, such as a child, is placed in the swing 16. In addition to the outward pressure force generated by the adjustable support bar 12, the pair of attachment straps 46 and the friction member 86 attached to the lateral side surface 56 independently act to hold the mounting brackets 14 in place and further limit vertical movement of the mounting brackets 14 relative to the upright members 22.

In prior art devices, the lateral force provided by the support bar 12 was the only force holding the structure in place on the upright members 22. Thus, if the support bar 12 was loosened inadvertently, the entire structure could unexpectedly fall from the door frame 24. In the present invention, both the outward force supplied by the support bar 12 and lateral force supplied by the attachment straps 46 combine to hold the mounting brackets 14 in place relative to the upright members 22. Thus, if the support bar 12 were loosened, the attachment straps 46 would still hold the mounting brackets 14 and the swing support assembly 10 in place.

Referring now to FIG. 3, one of the mounting brackets 14 includes a door stop member 48. When the swing support assembly 10 is properly installed in the door frame 24, as shown in FIG. 1, the mounting bracket 14 positioned along the upright member 22 to which the door 28 is also connected contains the door stop member 48. The door stop member 48 includes a body portion 92 that extends along a longitudinal axis and terminates at one end with a flange 94 that extends at a 90° angle relative to the body portion 92. The door stop member 48 further includes an adjustment slot 96 that extends in a direction parallel to the longitudinal axis of the door stop member 48. The door stop member 48 is attached to the bracket body 44 by threaded connector 98 which passes through the adjustment slot 96 and is received in an internally threaded bore 100, FIG. 6, contained in the bracket body 44. The threaded connector 98 can be tightened to secure the door stop member 48 to the bracket body 44. The threaded connector 98 includes a flange 102 that has a diameter larger than the width of the adjustment slot 96, such that as the threaded connector 98 is tightened, the doorstop member 48 is pressed between the flange 102 and the front face 52 of the bracket body 44. As can be understood in FIG. 3, the distance the flange 94 extends outward away from the lateral side surface 56 of the bracket body 44 can be adjusted by loosening the threaded connector 98 and moving the door stop member 48 such that the threaded connector 98 moves within the adjustment slot 96. By being able to adjust the distance between the flange 94 and the bracket body 44, the swing support assembly 10 can be used on a wide variety of door frames 24.

Referring now to FIGS. 3 and 4, when the door 28 is in the open position, the door stop member 48 is extended perpendicular to the longitudinal axis of the bracket body 44 until the flange 94 contacts the edge surface of the door 28. When the flange 94 is in the extended position shown in FIGS. 3 and 4, the threaded connector 98 is tightened to securely hold the door stop member 48 in place. When the door stop member 48 is positioned as shown in FIGS. 3 and 4, the door stop member 48 prevents door 28 from being closed. Thus, the door 28 is prevented from contacting a child using the swing 16 attached to the swing support assembly 10. By using the threaded connector 98 and adjustment slot 96, the length of the door stop member 48 can be adjusted based on the individual door frame 24 and door upon which the swing support assembly 10 is being used.

In the preferred embodiment of the invention, the door stop member 48 includes a removed notch 104 which is used when storing the door stop member 48 in the position shown by the phantom lines in FIG. 3. To store the door stop member 48, the threaded connector 98 is loosened and the door stop member 48 is rotated about the threaded connector 98 to the position shown in phantom in which the door stop member 48 is parallel to the longitudinal axis of the bracket body 44. Preferably, the notch 104 has a radius which generally corresponds to the outer radius of the first bar member 30 such that when the door stop member 48 is rotated to the storage position shown in phantom in FIG. 3, the first bar member 30 will be seated in the notch 104. After the door stop member 48 has been rotated to the position shown in FIG. 3, the threaded connector 98 is tightened to securely hold the door stop member 48 in the storage position.

Figure 7:
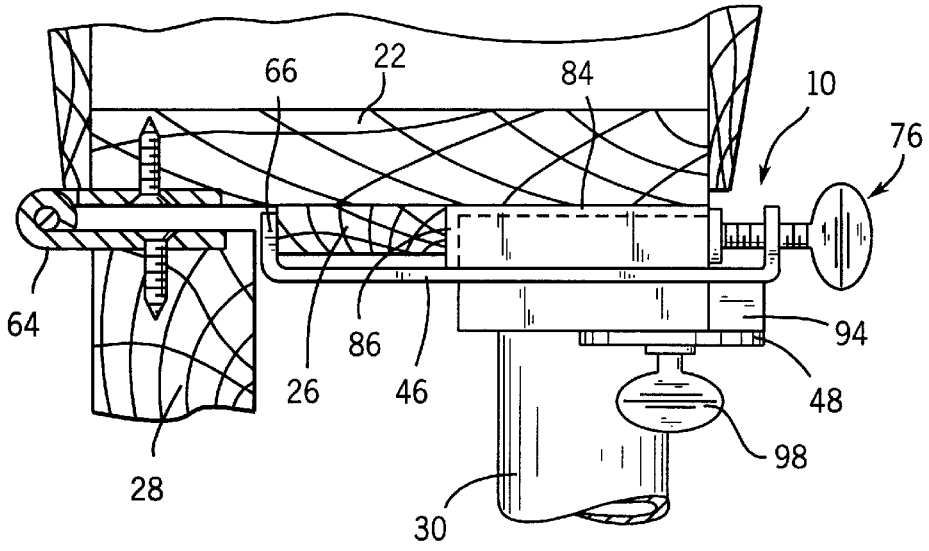
FIG. 7 is a top view similar to FIG. 4 showing the door stop in its storage position.

When the door stop member 48 is in the storage position as shown in FIG. 7, the door 28 can be closed while the swing support assembly 10 remains attached to the door frame 24. As shown in FIG. 7, the door 28 will contact the engagement portion 66 of the attachment strap 46 while still allowing the door 28 to close. Thus, the swing support assembly 10 can remain mounted to the door frame 24 and stored as such while still allowing the door 28 to be operated in a normal manner.

As previously discussed, the swing support assembly 10 can be used with other types of playground equipment, such as see-saws and a swinging bar. In another contemplated embodiment, the attachment rings 20 could be modified such that they would be identical to those used on outdoor swing sets, such that the swing 16 and the other equipment could be used with the swing support assembly 10 of the invention in the winter months, and then taken outside and used with a standard outdoor swing set during the summer months. Thus, the swing and other equipment could be used both inside and outside, thereby reducing the costs of the combined indoor and outdoor system.

I claim:

1. A swing support assembly for use between a pair of upright door frame members, each upright door frame member including an abutment strip extending from and positioned between a pair of door jamb surfaces, the support assembly comprising:

an adjustable length support bar having a first end and a second end, the support bar including adjustment means to vary the distance between the first and second ends;

a pair of mounting brackets, one of the mounting brackets being coupled to each of the first and second ends of the support bar, the mounting brackets having a front face, a back face and a bracket body extending along a longitudinal axis; and a pair of attachment straps associated with each of the mounting brackets, the attachment straps being spaced from each other along the longitudinal axis of the bracket body and extending perpendicular to the longitudinal axis of the bracket body, wherein the length of each attachment strap is adjustable such that when the mounting bracket is positioned adjacent to the abutment strip, the attachment straps engage the abutment strip to hold the mounting bracket in contact with the abutment strip.

2. The support assembly of claim 1, wherein the back face of the mounting bracket is planar, such that the entire back face of the mounting bracket contacts a portion of the upright door frame member when the swing support assembly is positioned between the pair of upright door frame members.

3. The support assembly of claim 1 further comprising a friction member connected to the back face of each mounting bracket, the friction member interacting with the door frame to restrict movement of the mounting bracket relative to the door frame.

4. The support assembly of claim 1 further comprising a door stop member attached to at least one of the mounting brackets.

5. A swing support assembly for use between a pair of upright door frame members, each upright door frame member including an abutment strip, the support assembly comprising:

an adjustable length support bar having a first end and a second end, the support bar including adjustment means to vary the distance between the first and second ends;

a pair of mounting brackets, one of the mounting brackets being coupled to each of the first and second ends of the support bar, the mounting brackets having a front face, a back face and a bracket body extending along a longitudinal axis;

a pair of attachment straps associated with each of the mounting brackets, the attachment straps extending perpendicular to the longitudinal axis of the bracket body, wherein the attachment straps engage the abutment strip to position the mounting bracket adjacent to the abutment strip; and a door stop member attached to at least one of the mounting brackets, wherein the door stop member extends perpendicular to the longitudinal axis of the bracket body and is movable perpendicular to the longitudinal axis of the bracket body such that the length of the door stop member extending past the bracket body can be adjusted.

6. The support assembly of claim 5 wherein the door stop member is movable between an extended position in which the door stop member extends perpendicular to the longitudinal axis of the bracket body and a storage position in which the door stop member extends parallel to the longitudinal axis of the bracket body.

7. The support assembly of claim 6 wherein the door stop member includes a storage notch.

8. The support assembly of claim 7 wherein the storage notch has a radius generally corresponding to the outer diameter of the support bar such that the support bar is received in the storage notch when the door stop is in the storage position.

9. The support assembly of claim 1 further comprising a socket positioned on the front face of each bracket body, such that the sockets receive the first and second ends of the support bar.

10. The support assembly of claim 1 further comprising adjustment means interconnected between each of the attachment straps and the mounting bracket, the adjustment means varying the length of the attachment straps extending from the bracket.

11. The support assembly of claim 1 further comprising a friction member contained on at least one side surface of the bracket body, the friction member contacting the abutment strip when the bracket body is positioned adjacent the abutment strip.

12. The support assembly of claim 1 further comprising a pair of slots formed in the bracket body between the front and back face, each of the slots receiving one of the attachment straps.

13. A swing support assembly for use between a pair of upright door frame members, each upright door frame member including an abutment strip, the support assembly comprising:

an adjustable length support bar having a first end and a second end, the support bar including adjustment means to vary the distance between the first and second ends;

a pair of mounting brackets, the first mounting bracket being coupled to the first end of the support bar and the second mounting bracket being coupled to the second end of the support bar, the mounting brackets each having a front face, a back face, and a bracket body extending along a longitudinal axis;

a pair of adjustable attachment straps associated with each of the mounting brackets, the attachment straps extending perpendicular to the longitudinal axis of the bracket body;

an adjustment means interconnected between each of the attachment straps and the mounting bracket for varying the length of the attachment strap extending past a side surface of the bracket body;

a friction member connected to the back face of each mounting bracket, the friction member interacting with the door frame to restrict movement of the mounting bracket relative to the door frame; and a door stop member attached to at least one of the mounting brackets, the door stop member being movable between an extended position in which the door stop member extends perpendicular to the longitudinal axis of the bracket body and a storage position in which the door stop member extends parallel to the longitudinal axis of the bracket body.

14. The support assembly of claim 13 further comprising a socket positioned on the front face of each bracket body, such that the socket contained on the bracket body receives either the first or second end of the support bar.

15. The support assembly of claim 13 wherein each of the attachment straps is received in a slot formed in the bracket body between the front face and the back face.

16. The support assembly of claim 13 wherein the door stop member includes an adjustment means such that the length of the door stop member extending past a side surface of the bracket body and perpendicular to the longitudinal axis of the bracket body can be adjusted.

17. A swing support assembly for use between a pair of upright door frame members, each upright door frame member including an abutment strip extending from a generally planar door jamb, the support assembly comprising:

an adjustable length support bar having a first end and a second end, the length of the support bar being adjustable to vary the distance between the first and second ends;

a pair of mounting brackets, one of the mounting brackets being coupled to each of the first and second ends of the support bar, the mounting brackets having a front face, a back face and a bracket body extending along a longitudinal axis; and at least one attachment strap associated with each of the mounting brackets, the attachment strap extending perpendicular to the longitudinal axis of the bracket body, wherein the length of the attachment strap is adjustable such that when the mounting bracket is positioned adjacent to the abutment strip, the attachment strap engages the abutment strip and the length of the attachment strap is adjusted to force the mounting bracket body into contact with the abutment strip.

* * * * *